US005285539A

United States Patent [19]

Anderson et al.

[11] Patent Number: 5,285,539

[45] Date of Patent: Feb. 15, 1994

[54] SHOWER BATH FOR A BEDRIDDEN PATIENT

[75] Inventors: Clifford M. Anderson, Nevada City; Gary A. Schaal, Loma Rica, both of Calif.

[73] Assignee: Andermac, Inc., Yuba City, Calif.

[21] Appl. No.: 933,618

[22] Filed: Aug. 21, 1992

Related U.S. Application Data

[63] Continuation of Ser. No. 659,944, Feb. 22, 1992, abandoned.

[51] Int. Cl.[5] ..... A47K 3/12

[52] U.S. Cl. ..... 4/564.1; 4/585; 5/83.1; 5/86.1

[58] Field of Search ..... 4/560.1, 564.1-566.1, 4/573, 585-587, 604, 611; 5/604, 612, 83.1, 84.1, 85.1, 86.1

[56] References Cited

U.S. PATENT DOCUMENTS

| | | | |
|---|---|---|---|
| 693,300 | 2/1902 | Mueller . | |
| 1,369,638 | 2/1921 | Edmonds et al. | 4/573 |
| 1,450,827 | 4/1923 | Wood | 4/573 |
| 1,817,596 | 8/1931 | Whalen | 4/585 X |
| 2,188,592 | 1/1940 | Cunningham . | |
| 2,607,925 | 8/1952 | DePuy | 4/586 X |
| 2,659,090 | 11/1953 | Westfahl | 4/587 |
| 2,690,177 | 9/1954 | Hogan . | |
| 2,798,229 | 7/1957 | McQuown | 4/564.1 |
| 2,908,916 | 10/1959 | Fischer . | |
| 3,187,350 | 6/1965 | Steven | 5/83.1 X |
| 3,226,734 | 1/1966 | Coventon . | |
| 3,238,539 | 3/1966 | Koch . | |
| 3,259,922 | 7/1966 | Fischer . | |
| 3,302,281 | 2/1967 | Stryker . | |
| 3,334,360 | 8/1967 | Hoxeng et al. . | |
| 3,451,070 | 6/1969 | Danielson | 5/83.1 |
| 3,564,625 | 2/1971 | Danielson . | |
| 3,755,830 | 9/1973 | Johns | 4/585 |
| 3,813,712 | 6/1974 | Bonnin | 5/110 X |
| 3,815,164 | 6/1974 | Smith . | |
| 3,827,089 | 8/1974 | Grow . | |
| 3,865,104 | 2/1975 | Paulson, et al. . | |
| 3,874,010 | 4/1975 | Geary . | |
| 4,244,358 | 1/1981 | Pyers . | |
| 4,356,577 | 11/1982 | Taylor . | |
| 4,434,517 | 3/1984 | Dorris . | |
| 4,485,502 | 12/1984 | Marcanio . | |
| 4,713,850 | 12/1987 | Flaherty et al. | 4/585 |
| 4,771,489 | 9/1988 | Chen et al. . | |
| 4,939,801 | 7/1990 | Schaal et al. . | |
| 4,958,389 | 9/1990 | Hammett . | |
| 5,005,233 | 4/1991 | Toivio et al. | 5/83.1 |

FOREIGN PATENT DOCUMENTS

| | | | |
|---|---|---|---|
| 0248537 | 12/1987 | European Pat. Off. . | |
| 144772 | 9/1903 | Fed. Rep. of Germany . | |
| 2848461 | 5/1979 | Fed. Rep. of Germany | 4/585 |
| 791562 | 9/1935 | France . | |
| 359837 | 3/1962 | France . | |
| 2507471 | 12/1982 | France . | |
| 685883 | 1/1953 | United Kingdom . | |

OTHER PUBLICATIONS

Amerilift ® Patient Handling System.

*Primary Examiner*—Charles E. Phillips

*Attorney, Agent, or Firm*—Townsend and Townsend Khourie and Crew

[57] ABSTRACT

A flexible bathing fluid permeable mesh sheet is attached to a rectangular frame. A flexible and collapsible bathing fluid impermeable sheet is attached to the frame below the mesh sheet and spaced apart therefrom for forming an open fluid receptacle. The mesh sheet is attached to the frame with straps which may be adjusted for allowing the patient to be placed substantially coplanar with the frame and away from the fluid collected in the impermeable sheet or lowered toward the impermeable sheet to provide an immersion bath.

5 Claims, 4 Drawing Sheets

SHOWER BATH FOR A BEDRIDDEN PATIENT

This is a Continuation of application Ser. No. 07,659,944 filed Feb. 22, 1992, now abandoned.

BACKGROUND OF THE INVENTION

This invention relates to bathing devices and, more particularly, to an apparatus for showering and/or bathing bedridden patients.

In hospitals and nursing homes it is generally accepted practice to administer baths to bedridden patients by rubbing the patient's body with a hand-held sponge soaked in warm soapy water or some other bathing fluid. The procedure is time consuming and messy and involves frequent moving of the patient. The rubbing may in itself be deleterious to patients having particular skin disorders. The bed also tends to become somewhat moist and uncomfortable to the patient.

If a sponge bath is inadvisable for one reason or another, then it is necessary to move the patient from the bed and into some sort of bathtub. This requires lifting the patient out of the bed and into the bathtub, thus risking injury to the nursing staff and especially to the patient if the patient has wounds or particularly sensitive skin which could be abraded or torn by the procedure. Once the patient is placed in the bathtub, then the patient is subjected not only to the cleansing fluid but also to the contaminated bathing fluid remaining in the tub. This can lead to serious consequences when wounds (and especially infectious wounds) are being cleansed. Furthermore, the bathtub ordinarily comprises a rigid surface which decreases ventilation and creates pressure points against localized areas of the patient's body, thus increasing the possibility of injury to and discomfort of the patient.

SUMMARY OF THE INVENTION

The present invention is directed to a shower-bath for a bedridden patient wherein the patient may be provided with a shower or bath without encountering the problems inherent in known bathing devices. For example, the patient need not be manually lifted by the nursing staff, the patient may be supported in or out of the bathing fluid, and the supporting surface distributes the load of the patient substantially uniformly over the patient's entire body while still providing proper ventilation.

In one embodiment of the present invention, a flexible bathing fluid permeable mesh sheet is attached to a rectangular frame. A flexible and collapsible bathing fluid impermeable sheet is attached to the frame below the mesh sheet and spaced apart therefrom for forming an open fluid receptacle. The mesh sheet is attached to the frame with straps which may be adjusted for allowing the patient to be placed substantially coplanar with the frame and away from the fluid collected in the impermeable sheet or lowered toward the impermeable sheet to provide an immersion bath.

DESCRIPTION OF THE PREFERRED EMBODIMENT

Figure 1:
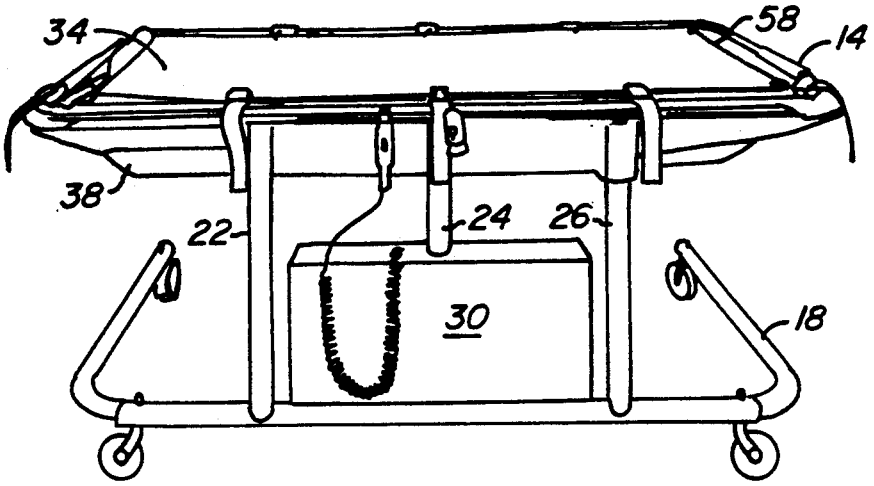
FIG. 1 is a perspective view of a particular embodiment of a shower-bath according to the present invention.

FIG. 1 is a perspective view of a particular embodiment of a shower-bath 10 according to the present invention. Shower-bath 10 comprises a planar member such as a rectangular frame 14 mounted on a base 18 by telescoping supports 22, 24 and 26. A height control unit 30 is coupled to telescoping support 24 for automatically raising or lowering frame 14 for reasons which will become apparent below. A bathing fluid permeable flexible mesh sheet 34 is attached to frame 14 for supporting a patient in generally horizontal position, and bathing fluid impermeable plastic sheet 38 is attached to frame 14 below sheet 34 for forming a fluid receptacle.

Figure 2:
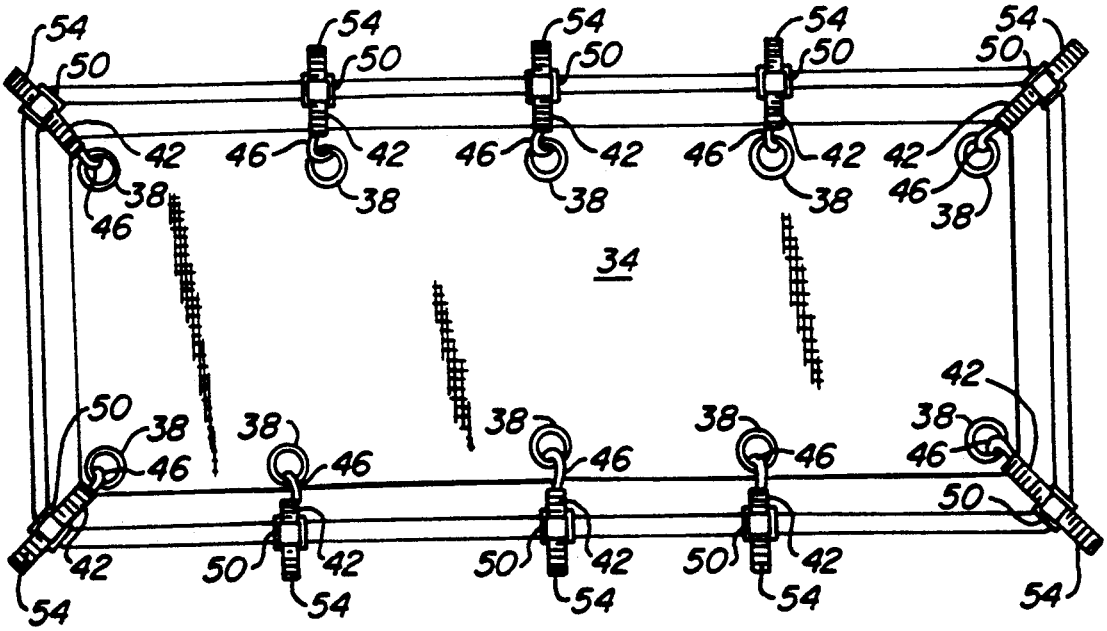
FIG. 2 is a top plan view of the shower-bath of FIG. 1 showing a particular embodiment of a mesh sheet attached to the frame.

FIG. 2 is a top plan view of shower-bath 10 showing more clearly the attachment of mesh sheet 34. As shown in FIG. 2, mesh sheet 34 includes a plurality of grommets 38 disposed along the periphery thereof. A corresponding plurality of straps 42 each have a hook 46 attached to a first end thereof for extending through a corresponding grommet 38. A plurality of buckles 50 (preferably self-locking) are affixed to frame 14. Each buckle 50 receives a second free end 54 of a corresponding strap 42. The buckle selectively clamps or releases its associated strap 42 for adjusting the position of mesh sheet 34. If desired, mesh sheet 34 may be maintained substantially coplanar with frame 14 for keeping the patient away from the fluid collected in fluid impermeable sheet 38. Alternatively, mesh sheet may be lowered toward fluid impermeable sheet 38 when an immersion bath is desired.

Figure 3:
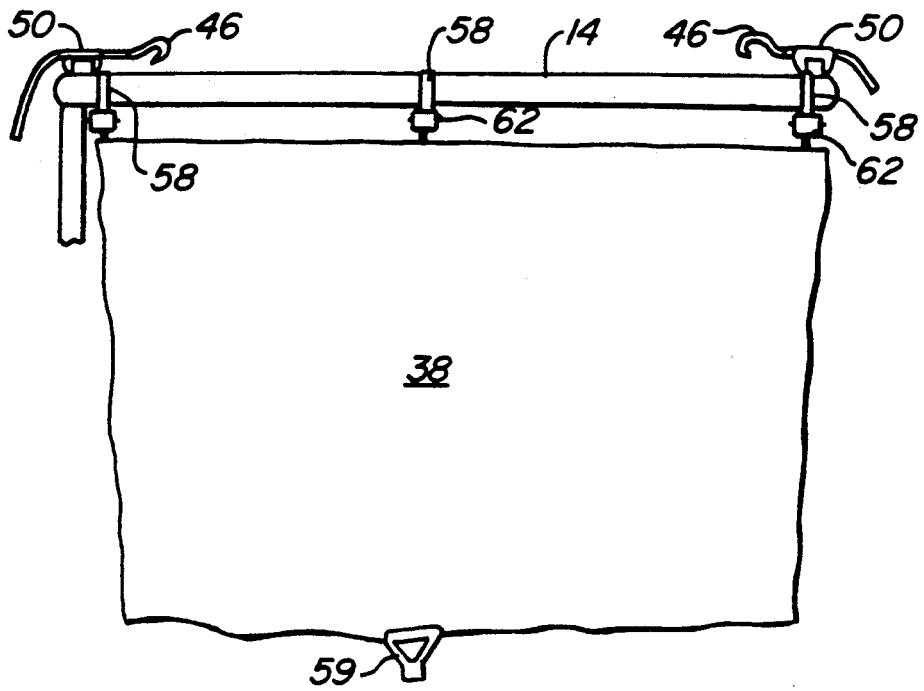
FIG. 3 is a partial side view of the shower-bath of FIG. 1 illustrating the attachment of the bathing fluid impermeable sheet in an extended position.
Figure 4:
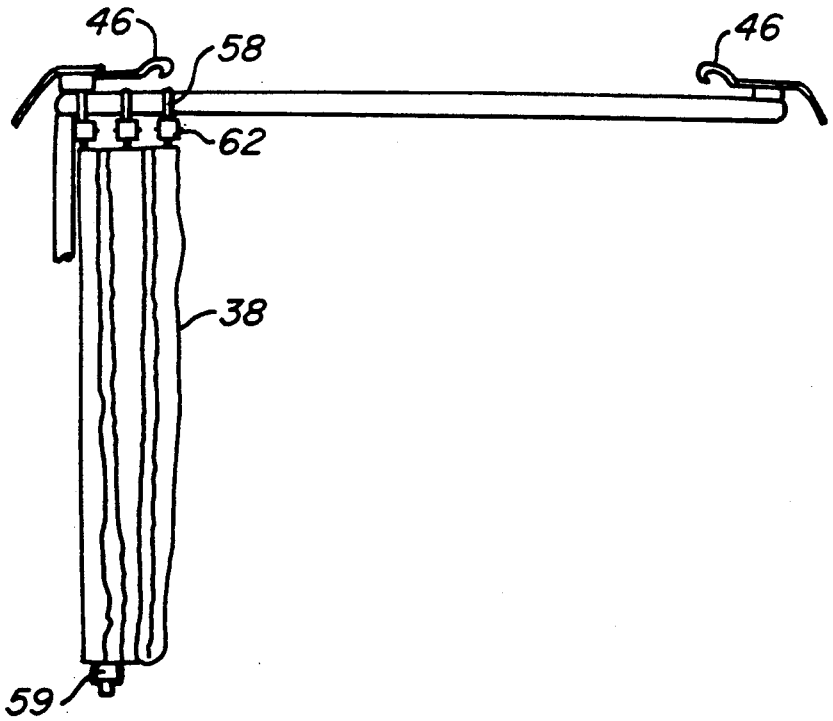
FIG. 4 is a partial side view taken of the shower-bath of FIG. 1 showing the impermeable sheet in a retracted position.

FIGS. 3 and 4 are side views of a portion of shower-bath 10 showing more clearly how fluid impermeable sheet 38 is attached to frame 14. FIG. 3 shows sheet 38 in an extended position, and FIG. 4 shows sheet 38 in a retracted position. Sheet 38 includes a plurality of straps 58 for slidably affixing sheet 38 to frame 14. Each strap 58 has a buckle 62 for disengaging the strap and allowing fluid impermeable sheet 38 to be selectably coupled to frame 14. A drain 59 is disposed on the bottom of fluid impermeable sheet 38 for draining the bathing fluid therefrom. If desired, drain 59 may be coupled to a hose (not shown) which may be routed to a sink, a floor drain, a container, or some other disposal facility.

Figure 5:
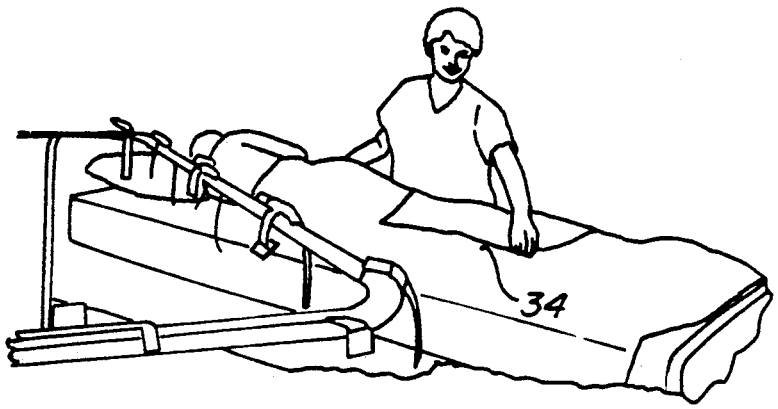
FIGS. 5-9 are drawings showing the set up and use of the shower-bath shown in FIG. 1.
Figure 6:
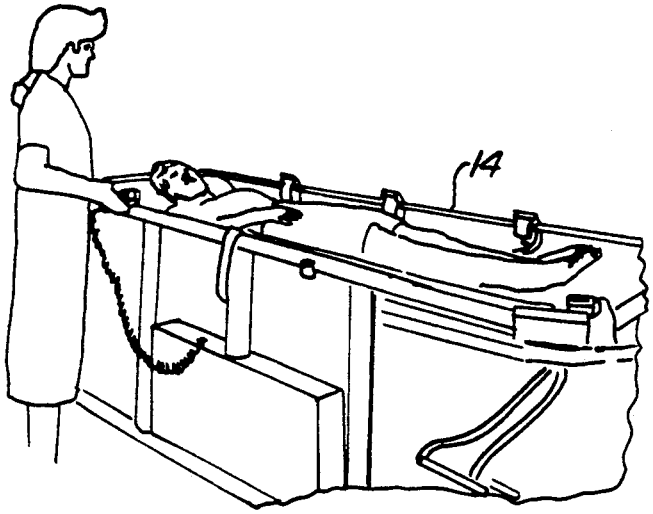

FIGS. 5-9 show how shower-bath 10 is set up and used. As shown in FIG. 5, the patient is initially rolled onto his or her side, and mesh sheet 34 is placed on the patient's bed in a spread out condition. The patient is then rolled back onto mesh sheet 34 as shown in FIG. 6. Frame 14 is then placed over the patient and, using height control unit 30, lowered so that frame 14 is substantially coplanar with sheet 34. Hooks 46 are then inserted into corresponding grommets 38 in sheet 34, and buckles 50 are set to clamp straps 42 in place for affixing sheet 34 to frame 14. Height control unit 30 is then used to raise frame 14, and hence the patient, to the position shown in FIG. 7. Because mesh sheet 34 is flexible, it evenly distributes the load of the patient over the patient's entire body.

Figure 7:
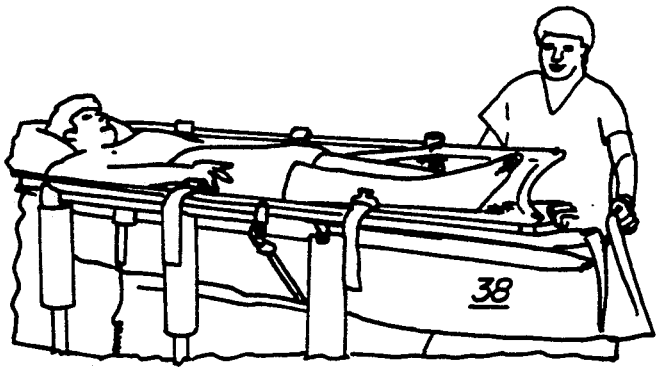
Figure 8:
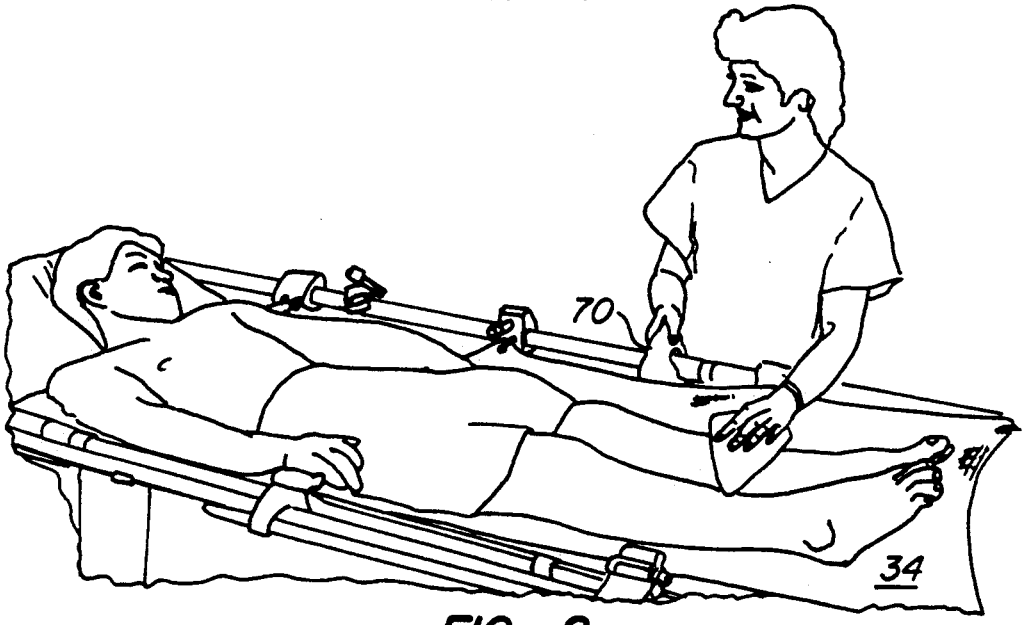
Figure 9:
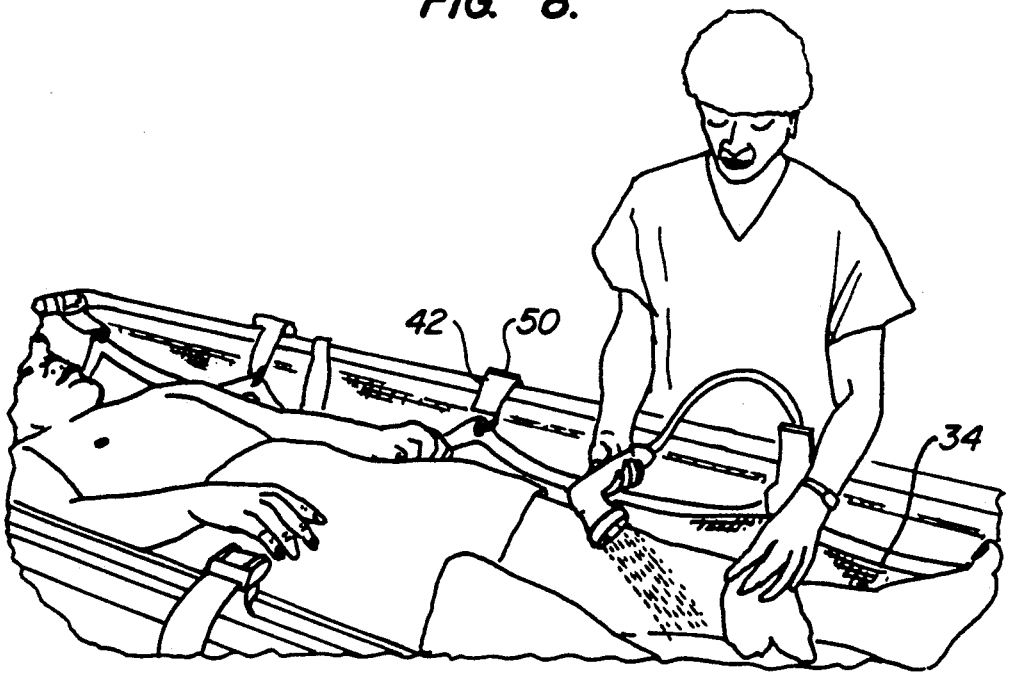

Once frame 14 is in the raised position, the fluid impermeable sheet 38 may be moved to the extended position and affixed as shown in FIG. 7. If desired, frame 14 may be lowered (or the patient's bed raised) so that the bottom of fluid impermeable sheet 38 rests on the patient's bed. This provides support for the fluid-filled sheet and helps to form a properly shaped bathinette. The patient then may be showered with a shower head 70 as shown in FIG. 8, with fluid impermeable sheet 38 collecting the used bathing fluid. Since fluid impermeable sheet 38 is spaced apart from flexible sheet 34, and since sheet 34 is an open mesh sheet, the underside of the patient may be bathed by reaching beneath sheet 34 and aiming shower head 70 upwardly. If an immersion bath is desired, then drain 59 is closed and fluid impermeable sheet 38 is partially filled with bathing fluid. Buckles 50 may be released one at a time and straps 42 slightly extended for lowering mesh sheet 34 toward fluid impermeable sheet 38. The patient thus may be immersed in the bathing fluid contained in fluid impermeable sheet 38. After the bathing operation is complete, the bathing fluid may be drained through drain 59, and the procedure reversed for returning the patient to his or her bed.

While the above is a complete description of a preferred embodiment of the present invention, various modifications may be employed. For example, mesh sheet 34 may be replaced by a perforated sheet or even a rigid platform if particular patients do not need the flexibility and uniform support of mesh sheet 34. Both mesh sheet 34 and impermeable sheet 38 may be attached to frame 14 using clips rather than straps. Frame 14 may be circular or comprise some other open or closed polygon comprising a plurality of rectilinear frame members. Consequently, the full scope of the invention should be ascertained by the appended claims.

What is claimed is:

1. A bath apparatus for bathing a patient within a hospital bed supported on a hospital floor comprising in combination:

a rectilinear frame having parallel opposite sides about an unobstructed internal rectilinear dimension for fitting over from above and surrounding said patient within said hospital bed;

a rolling transport for supporting said rectilinear frame from the floor supporting said hospital bed at one edge of said rectilinear frame, said frame and rolling transporting being independent of said hospital bed;

means for raising and lowering said rectilinear frame with respect to said rolling transport at said one edge of said transportable frame for enabling said rolling transport to be moved under said hospital bed with said frame supported over said hospital bed in a position overlying said patient in said bed;

a water permeable sheet;

means for tensile attachment of said water permeable sheet to said rectilinear frame with said water permeable sheet underlying said patient on said bed;

a water impermeable sheet for suspension from said frame in an upwardly exposed concave configuration for forming a liquid retaining bath with respect to said frame; and means for attachment of said water impermeable sheet to said frame with said water impermeable sheet extending below said water permeable sheet independent of said means for tensile attachment of said water permeable sheet for supporting said water impermeable sheet with respect to said frame with said exposed concave configuration for receiving and retaining the water of said bath while the patient is supported by said water permeable sheet over said bed.

2. The invention of claim 1 and wherein:

said water impermeable sheet is partially supported on said bed.

3. The invention of claim 2 and wherein said water impermeable sheet has a drain.

4. The invention of claim 2 and wherein said means for attachment of said water impermeable sheet provides means for attachment of said water permeable sheet to the first parallel opposite sides of said frame; and, said means for attachment of said water impermeable sheet includes, means for sliding attachment of said water impermeable sheet to second parallel opposite sides of said frame whereby said water impermeable sheet can have sliding movement under said water permeable sheet when said patient is support from said frame on said water permeable sheet.

5. The invention of claim 2 and wherein said attachment means providing for variable tensile support of said sheet with respect to said frame whereby a patient supported on said sheet can be supported from said frame at variable elevation.

* * * * *